United States Patent [19]

Furukawa

[11] 4,095,568

[45] Jun. 20, 1978

[54] ALTITUDE COMPENSATING APPARATUS FOR USE WITH AN INTERNAL COMBUSTION ENGINE

[75] Inventor: Akira Furukawa, Kariya, Japan

[73] Assignee: Nippondenso Co., Ltd., Kariya, Japan

[21] Appl. No.: 699,164

[22] Filed: Jun. 23, 1976

[30] Foreign Application Priority Data

Jun. 24, 1975 Japan ..... 50-87356
Jul. 24, 1975 Japan ..... 50-102579

[51] Int. Cl.[2] ..... F02P 5/04; F02P 5/14
[52] U.S. Cl. ..... 123/117 A; 123/120
[58] Field of Search ..... 123/117 A, 119, 119 D, 123/120, 123; 261/137

[56] References Cited

U.S. PATENT DOCUMENTS

| | | | |
|---|---|---|---|
| 2,778,892 | 1/1957 | Vanderpoel | 123/117 A |
| 3,828,743 | 8/1974 | Ludwig | 123/117 A |
| 3,933,166 | 1/1976 | Gould et al. | 123/117 A |
| 3,948,232 | 4/1976 | Gould et al. | 123/117 A |
| 3,960,126 | 6/1976 | Shinoda | 123/120 |

*Primary Examiner*—Charles J. Myhre
*Assistant Examiner*—R. A. Nelli
*Attorney, Agent, or Firm*—Cushman, Darby & Cushman

[57] ABSTRACT

An altitude compensating apparatus for use with an engine includes a bellows in which the air or gas is confined at a predetermined suitable pressure. The bellows expands as the atmospheric pressure lowers on the high lands. A first valve operatively connected to the bellows opens air outlet to introduce the air into air bleeds of a carburetor with the expansion of the bellows thereby to reduce the fuel mixed with the air in the carburetor. A second valve connected to the bellows operates to introduce the negative pressure into a vacuum advancer of a distributor with the expansion of the bellows thereby to advance the ignition timing of the engine.

5 Claims, 5 Drawing Figures

ALTITUDE COMPENSATING APPARATUS FOR USE WITH AN INTERNAL COMBUSTION ENGINE

BACKGROUND OF THE INVENTION

The present invention relates to the altitude compensating apparatus for use with an internal combustion engine, which compensates the decrease of the air to fuel ratio of the mixture, sucked in the engine, caused by the lowering of the density of the air so as to keep the air to fuel ratio at an optimum value when the engine is operated on the high lands.

In a conventional carburetor for supplying the air-fuel mixture to the engine, the fuel is sucked in an air passage in response to the negative pressure produced by the air flow in the air passage, being mixed with the air flowing through the air passage. It is known that the air to fuel ratio of the mixture thus produced decreases or becomes rich as the density of the air lowers. The density of the air is also known to change with the altitude. Therefore, on the high lands the mixture produced in a conventional carburetor and sucked in the engine becomes so rich as to increase the unburned harmful components in the exhaust gases from the engine.

SUMMARY OF THE INVENTION

It is, therefore, an object of the present invention to provide an altitude compensating apparatus which compensates the decrease of the air to fuel ratio of the mixture sucked in the engine so as to maintain the richness of the mixture at an optimum value on a high land.

It is another object of the present invention to provide an altitude compensating apparatus which on a high land advances the ignition timing of the engine to increase the engine power as well as compensates the decrease of the air to fuel ratio of the mixture.

The other objects, features and advantages of the present invention will become apparent from the following detailed description of the preferred embodiments.

DESCRIPTION OF THE PREFERRED EMBODIMENTS

Figure 1:
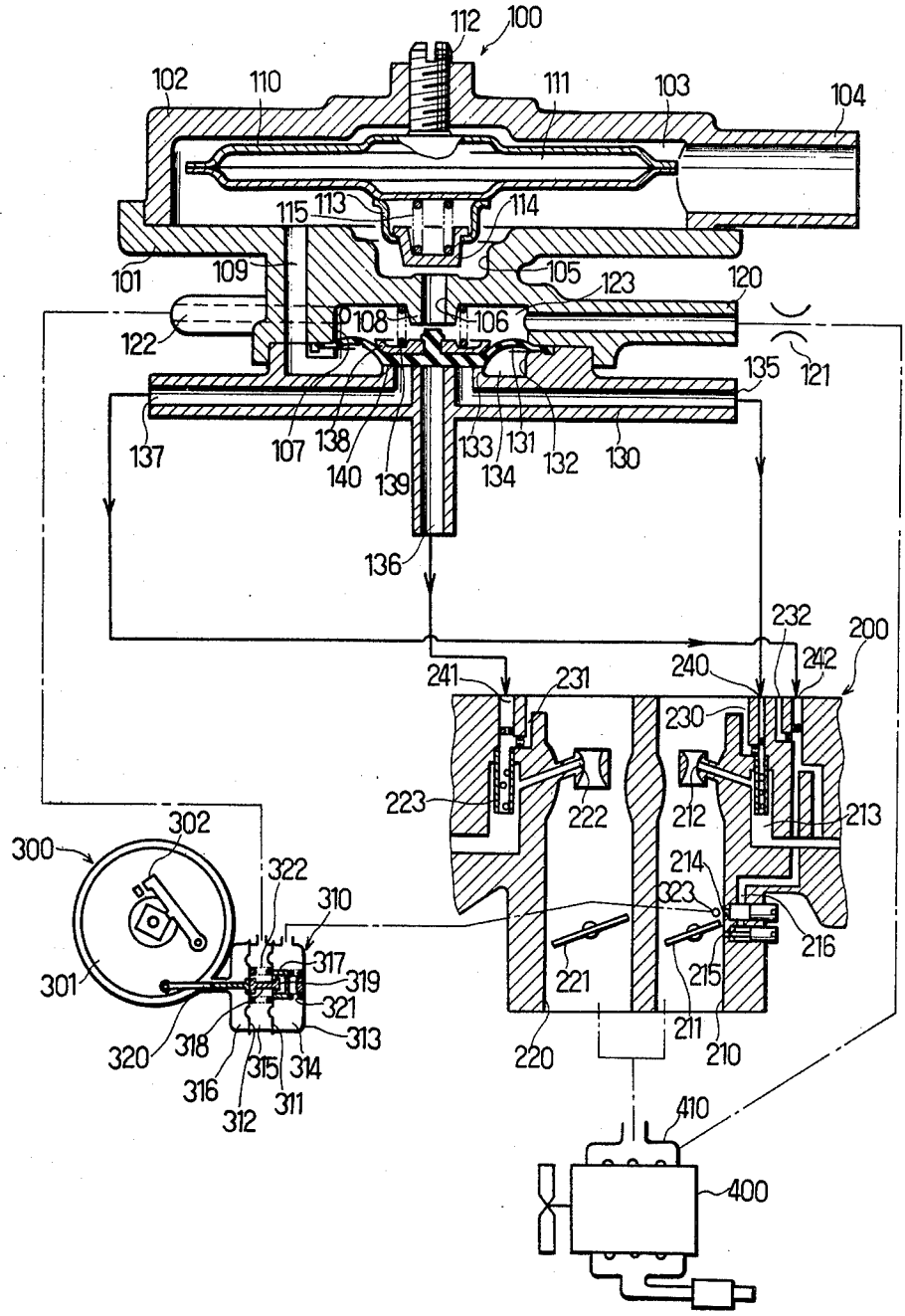
FIG. 1 illustrates in cross-section an altitude compensating apparatus of the first embodiment according to the present invention together with a carburetor and a distributor of an engine.

Referring to FIG. 1, the altitude compensating apparatus 100 of the invention is illustrated as being connected to a carburetor 200 and a distributor 300 of an internal combustion engine 400.

The carburetor 200 shown in FIG. 1 is of the common type having primary and secondary barrels or air passages 210 and 220 both communicating with an intake manifold 410 of the engine 400, in which primary and secondary throttle valves 211 and 221 are respectively disposed. The throttle valves 211 and 221 control the flow rate of the air passing through the air passages 210 and 220 in a conventional manner. Primary and secondary main fuel nozzles 212 and 222 respectively open to the venturies formed in the air passages 210 and 220, communicating with a fuel bowl (not shown) through main fuel passages 213 and 223 respectively. The fuel in the fuel bowl is delivered from the main fuel nozzles 212 and 222 into the air passages 210 and 220 to be mixed with the air, thereby producing an air-fuel mixture in the air passages. Slow and idle ports 214 and 215 open to the primary air passage 210, communicating with the fuel bowl through a slow fuel passage 216. These ports serve to deliver the fuel to produce an air-fuel mixture in an idling and low speed operation of the engine 400. As well known in the art, the air to fuel ratio of the mixture thus produced varies in accordance with the change of the density of the air, that is in proportion to $1/\sqrt{\rho}$ wherein $\rho$ designates the density of the air.

Air bleeds 230, 240; 231, 241; and 232, 242 respectively communicate with the fuel passages 213, 223 and 216 so as to supply the air to the fuel flowing therethrough and control the quantity of the fuel delivered into the air passages 210 and 220. Each of the air bleeds 230, 231 and 232 is a conventional main air bleed communicating with the atmosphere and others are sub air bleeds 240, 241 and 242 to which the altitude compensating apparatus 100 is connected.

The distributor 300 is of the known type including a disk 301 on which a breaker 302 is mounted and a vacuum advancer 310 connected to the disk 301 for controlling the spark ignition timing in response to the engine operating condition. In the advancer 310, the first and a second diaphragms 311 and 312 are disposed within a casing 313, forming with the casing three chambers 314, 315 and 316. The first diaphragm 311 has a cup-shaped member 317, fixed to the central portion thereof and disposed in the first chamber 314, with which a flange 319 of a sub rod 318 engages. The sub rod 318 is fixed to the center of the second diaphragm 312, restricting the distance between the first and second disphragms 311 and 312. A main rod 320 is fixed to the center of the second disphragm 312 at its one end, extending from the casing 313 and being connected to the disk 301 at the other end thereof. The main rod 320 is moved by the deflection of the second diaphragm 312 to rotate the disk 301.

A first spring 321 is disposed between the casing 313 and the cup-shaped member 317 for biasing the first disphragm 311 toward the second chamber 315. A second spring 322 is disposed between the first and second diaphragms 311 and 312 for biasing both of the diaphragms apart from each other.

To the first chamber 314 is transmitted the negative pressure in the carburetor 200 through a common port 323 opening to the primary air passage 210. To the second chamber 315 is transmitted the pressure from the altitude compensating apparatus 100. To the third chamber 316 is transmitted the atmospheric pressure. The negative pressure transmitted in the first chamber 314 deflects the first diaphragm 311 against the force of the spring 321, thereby deflecting the second disphragm 312 by means of the movement of the sub rod 318 to reciprocate the main rod 320. With the rightward movement of the main rod 320 or the anticlockwise rotation of the disk 301 the ignition timing is advanced.

In the altitude compensating apparatus 100 of the invention, a housing 101 and a cover 102 are coupled together to form therebetween an atmosphere chamber 103 to which an air inlet 104 formed on the cover 102 opens. The air inlet 104 is to communicate with an air cleaner not shown so that the fresh air passing through the air cleaner is introduced into the atmosphere chamber 103. The housing 101 has a first recess 105 formed on the central portion of the upper surface thereof and facing on the atmosphere chamber 103 and a through hole or air passage 106 opening to the recess 105.

In the atmosphere chamber 103 is disposed a bellows 110 which comprises a pair of disk-like plates made of spring materials and secured together airtightly at the periphery thereof. The bellows 110 forms an airtightly-sealed vacuum chamber 111 therein, in which the air or gas is confined at a suitable pressure. The bellows 110 is expansible or compressible in dependence upon the pressure difference between the pressures in the vacuum chamber 111 and the atmosphere chamber 103.

To the center of the upper surface of the bellows 110 is fixed on adjusting screw 112 which is screwed on the cover 102 to hold the bellows 110 in the atmosphere chamber 103. The setting position of the bellows 110 is adjusted by screwing or loosening the screw 112. A valve holder 113 holding a valve member 114 is fixed to the central portion of the lower surface of the bellows 110. The valve member 114, which is made of a rubber, is disposed in the recess 105 and faces on the upper opening end of the air passage 106 of the housing 101. A valve spring 115 is interposed between the valve member 114 and the bellows 110 to bias the valve member 114 downwardly. The valve member 114 is movable toward or apart from the upper opening end of the air passage 106 in accordance with the expansion or compression of the bellows 110.

The housing 101 has a second recess 107 formed on the lower surface thereof and a projection 108 formed on the bottom surface of the recess 107, the air passage 106 opening to the top surface of the projection 108. To the second recess 107 open a pressure inlet 120 communicating through an orifice 121 with the intake manifold 410 of the engine 400 and a pressure outlet 122 communicating with the second chamber 315 of the vacuum advancer 310.

A passage defining member or block 130 is secured to the lower surface of the housing 101 and serves to clamp a diaphragm 131 to the housing 101. The diaphragm 131 defines a pressure chamber 123 with the recess 107 of the housing 101. The block 130 has a recess 132 formed on the upper surface thereof and a projection 133 formed on the bottom surface of the recess 132. The recess 132 is covered with the diaphragm 131 to form with the same a sub atmosphere chamber 134 which communicates with the atmosphere chamber 103 through a passage 109 formed in the housing 101. The block 130 also has first, second and third air outlets 135, 136 and 137 formed therein, each of which opens to the top surface or valve seat of the projection 133. These outlets communicate with the sub air bleeds 240, 241 and 242 of the carburetor 200 respectively.

A plate or spring retainer 138 is fixed to the upper surface of the diaphragm 131. A spring 139 is interposed between the spring retainer 138 and the housing 101 to bias the diaphragm 131 downwardly. The diaphragm 131 has a flat portion or valve portion 140 on the lower central portion thereof which is seated on the valve seat of the projection 133 by the force of the spring 139. When the diaphragm 131 is deflected upwardly against the force of the spring 139, the valve portion 140 is lifted apart from the valve seat of the projection 133 thereby to open the air outlets 135~137 into the sub atmosphere chamber 134.

When the engine 400 is operated on a low land, the atmosphere chamber 103 of the altitude compensating apparatus 100 is supplied with the atmosphere having a normal atmospheric pressure i.e., about 760 mmHg. The bellows 110 is rather compressed as shown in FIG. 1 to lift the valve member 114 apart from the upper opening end of the air passage 106 so as to open the air passage 106. Therefore, the air in the atmosphere chamber 103 is introduced into the pressure chamber 123 through the air passage 106. The pressure chamber 123 is filled with the air introduced therein, being maintained at the atmospheric pressure, although the same communicates with the intake manifold 410 of the engine 400. Since the sub atmosphere chamber 134 is supplied with the atmosphere from the atmosphere chamber 103 through the passage 109, the valve portion 140 of the diaphragm 131 is seated on the valve seat of the projection 133 by the spring 139, thereby closing each of three air outlets 135~137.

Consequently, the sub air bleeds 240~242 of the carburetor 200 is supplied with no air, the fuel in the fuel passages being supplied with the air only through the main air bleeds 240~242. The carburetor 200 is adjusted to produce the air-fuel mixture of a predetermined optimum air to fuel ratio on a low land.

The atmospheric pressure from the pressure chamber 123 of the altitude compensating apparatus 100 is transmitted to the second chamber 315 of vacuum advancer 310, so that the first and second diaphragms 311 and 312 of the advancer are forced to deflect apart from each other by the second spring 322 and maintained at the most distant position restricted by the sub rod 318 relative to each other. In this relation of the first and second diaphragms, the advancer 310 is adjusted to suitably change the ignition timing in accordance with the negative pressure transmitted into the first chamber 314.

On a high land the atmospheric pressure (absolute value) lowers with rthe result that the density of the air becomes small dependently upon increase of altitude. The bellows 110 of the altitude compensating apparatus 100 expands by the spring action thereof with decrease of the atmospheric pressure acting on the outer surface thereof to move the valve member 114 together with the valve holder 113 downwardly. For example, on a high land at an altitude of 1000 m, the valve member 114 is seated on the bottom surface of the first recess 105 to close the air passage 106. As a result, only the negative pressure in the intake manifold 410 is transmitted into the pressure chamber 123 to deflect the diaphragm 131 upwardly against the force of the spring 139. This deflection of the diaphragm 131 causes the valve portion 140 to lift apart from the valve seat of the projection 133 thereby to open the three outlets 135~137. Then the sub air bleeds 240~242 are supplied with the air from the sub atmosphere chamber 134 through the air outlets 135~137 to introduce and mix the same with the fuel in the fuel passages 213, 223 and 216. With this air being mixed, the quantity of the fuel delivered into the air passages 210 and 220 is reduced.

As well known in the art, the air to fuel ratio of the mixture produced in the conventional manner in the carburetor decreases in accordance with the decrease of the density of the air. The altitude compensating apparatus 100 of the invention reduces the fuel delivered into the air passages 210 and 220 in accordance with decrease of the density of the air in the manner above-described, thereby keeping the air to fuel ratio of the mixture at the optimum value identical with the ratio on a low land.

On a high land, the altitude compensating apparatus 100 transmits the negative pressure in the pressure chamber 123 into the second chamber 315 of the vacuum advancer 310, with the result that the second diaphragm 312 is deflected rightwardly relative to the first diaphragm 311 until the flange 319 of the sub rod 318 touches the bottom surface of the cup-shaped member 317. With the deflection of the second diaphragm 312 the main rod 320 is shifted rightwardly to rotate the disk 301, thereby advancing the ignition timing so as to increase the engine power. Although the quantity of the air sucked in the engine 400 decreases as the density of the air becomes small, the altitude compensating apparatus 100 serves to maintain the demanded power of the engine 400 by advancing the ignition timing in accordance with the decrease of the air density.

Figure 2:
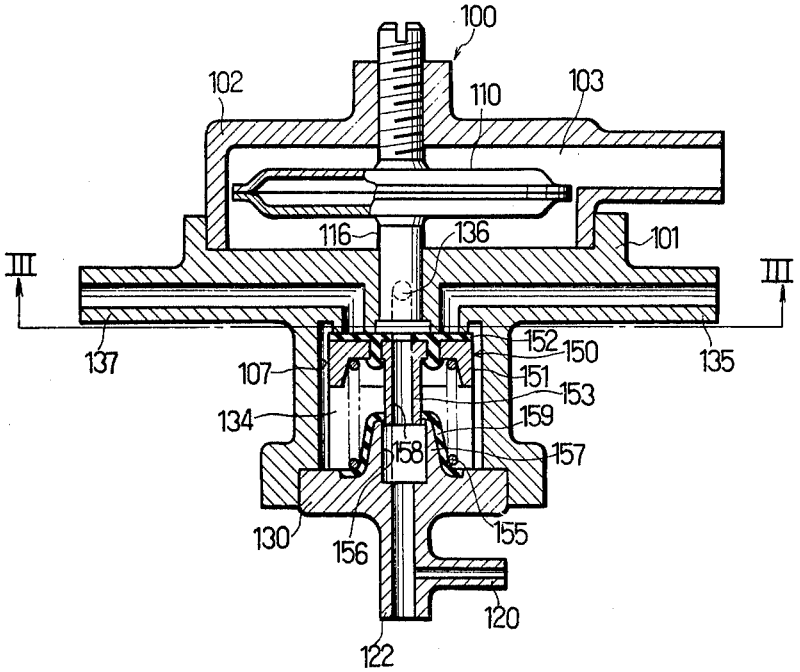
FIG. 2 illustrates in cross-section an altitude compensating apparatus of the second embodiment according to the present invention.
Figure 3:
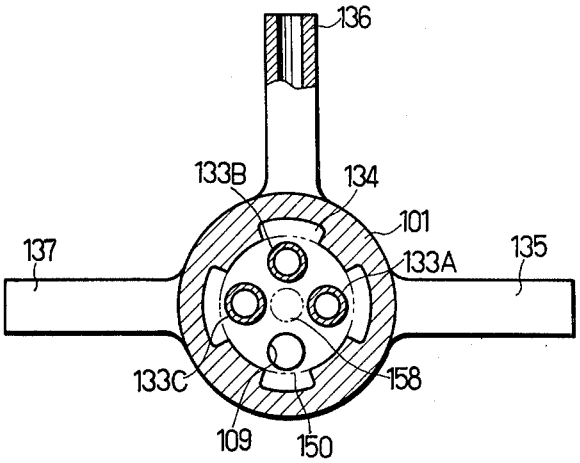
FIG. 3 is a sectional view taken on line III—III in FIG. 2.

FIG. 2 and FIG. 3 show the second embodiment of the altitude compensating apparatus wherein the same reference numerals designate the same or similar parts as the first embodiment.

In the altitude compensating apparatus 100 of this embodiment, a valve or shaft 116 is fixed to the lower surface of the bellows 110, being inserted in a through hole formed in the housing 101. A block 130 having a pressure inlet 120 and a pressure outlet 122 is secured to the housing 101, forming a sub atmosphere chamber 134 with the recess 107 of the housing 101, which communicates with the atmosphere chamber 103 through an air passage 109 formed in the housing 101. The pressure inlet 120 opens in the pressure outlet 122, being to be connected to the intake manifold 410 shown in FIG. 1, while the pressure outlet 122 being to connected to the second chamber 315 of the advancer 310 shown in FIG. 1. Three projections 133A, 133B and 133C are formed on the bottom surface of the recess 107, to the top surfaces thereof a first, a second and a third air outlets 135, 136 and 137 respectively opening. The air outlets 135, 136 and 137 are to be respectively connected to the sub air bleeds 240, 241 and 242 of the carburetor 200 shown in FIG. 1.

A valve 150 is disposed in the sub atmosphere chamber 134, being seated on the top surfaces of the projections 133A~133C by a valve spring 155. The valve 150 includes a valve body 151 and a valve member 152 secured to the upper surface of the body 151. The valve member 152 is made of a rubber and contacts with the top surfaces of the projections 133A~133C. The valve body 151 includes an extension 153 inserted in a bore 156 which is formed in a projection 157 formed on upper surface of the block 130 and communicates with the pressure outlet 122. A pressure passage 158 is formed through the extension 153 and the valve member 152, the lower end thereof communicating with the bore 156, while the upper end thereof opening to the upper surface of the valve member 152. A lip seal 159 is attached on the projection 157 of the block 130, contacting with the outer surface of the extension 153 to seal the bore 156 and the pressure passage 158 from the sub atmosphere chamber 134.

The altitude compensating apparatus 100 of the second embodiment operates as follows. On a low land, the valve 150 is seated on the projections 133A~133C to close the air outlets 135~137, thereby supplying no air to the sub air bleeds 240, 241 and 242 of the carburetor. The pressure passage 158 communicates with the sub atmosphere chamber 134, introducing the atmospheric pressure through the pressure outlet 122 to the second chamber 315 of the advancer 310.

On a high land, the shaft 116 is moved downwardly by the expansion of the bellows 110, contacting with the valve 150 to push the same downwardly, so that the pressure passage 158 is closed by the shaft 116 and all of the air outlets 135~137 are opened into the sub atmosphere chamber 134. Therefore, the apparatus 100 supplies the sub air bleeds 240, 241 and 242 of the carburetor with the air through the air outlets 135~137 and at the same time transmits the negative pressure to the second chamber of the advancer 310 from the intake manifold 410 through the pressure inlet and outlets 120 and 122.

Figure 4:
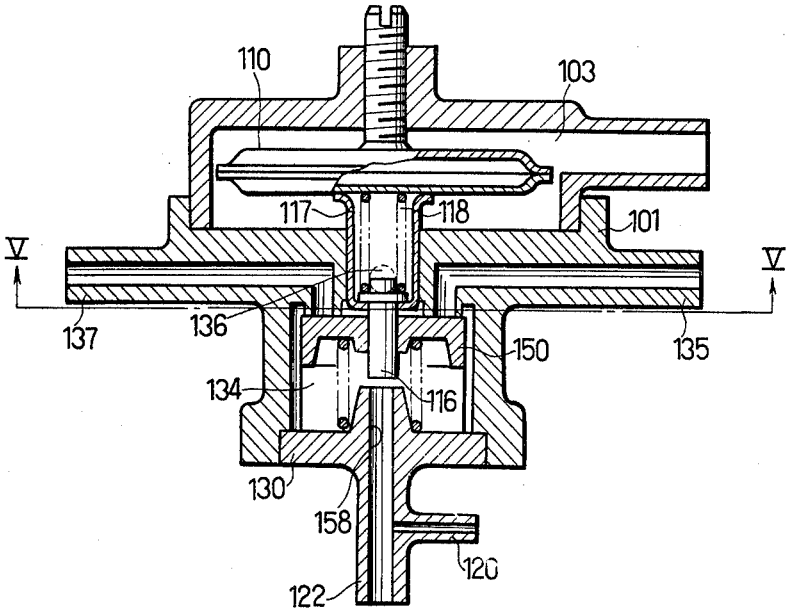
FIG. 4 illustrates in cross-section an altitude compensating apparatus of the third embodiment according to the present invention.
Figure 5:
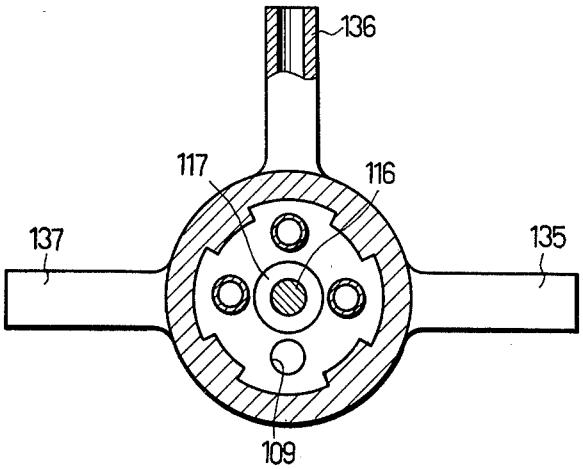
FIG. 5 is a sectional view taken on line V—V in FIG. 4.

FIG. 4 and FIG. 5 show the third embodiment of the altitude compensating apparatus according to the invention, wherein a valve or shaft 116 is held by a holder 117 secured to the bellows 110 and is inserted into the through hole formed in a valve 150. The lower end of the shaft 116 faces on the upper opening end of a pressure passage 158 formed in a block 130, the lower end of the holder 117 facing on the upper surface of the valve 150. A spring 118 biases the shaft 116 downwardly. The construction of the other parts of this embodiment is similar to that of the second embodiment.

In this altitude compensating apparatus, the shaft 116 and the holder 117 is moved downwwardly by the expansion of the bellows 110 on the high lands. Then the shaft 116 closes the pressure passage 158, while the holder 117 pushes the valve 150 downwardly thereby to open the air outlets 135~137.

What is claimed is:

1. An altitude compensating apparatus for use with an internal combustion engine comprising:

a housing having a first and a second air passage formed therein;

a cover secured to said housing for forming with said housing an atmosphere chamber to be supplied with the atmosphere;

a block secured to said housing;

a deflectable diaphragm interposed between said housing and said block for forming a pressure chamber with said housing and a sub-atmosphere chamber with said housing and a sub-atmosphere chamber with said block;

said pressure chamber and said sub-atmosphere chamber communicating with said atmosphere chamber through said first air passage and said second air passage respectively;

a pressure inlet and a pressure outlet both formed on said housing and communicating with said pressure chamber;

said pressure inlet and outlet being adapted for connection to an intake manifold and a vacuum advancer of a distributor of an engine, respectively;

at least one air outlet formed on said block and communicating with said sub-atmosphere chamber;

said air outlet being disposed for connection to an air bleed of a carburetor of the engine;

said diaphragm having a valve portion normally closing said air outlet;

said valve portion being disposed to open said air outlet with the deflection of said diaphragm when the negative pressure is transmitted in said pressure chamber and acts on said diaphragm;

at least one bellows disposed in said atmosphere chamber for forming therein a chamber to be confined with the air or gas at a predetermined pressure;

said bellows being of the type that expands as the atmospheric pressure decreases; and a valve connected to said bellows for normally opening said first air passage;

said valve being disposed to close said first air passage by the expansion of said bellows.

2. An altitude compensating apparatus for use with an internal combustion engine comprising;

a housing, a cover secured to said housing for forming with said housing an atmospheric chamber to be supplied with the atmosphere;

a block secured to said housing for forming a sub-atmosphere chamber with said housing;

said sub-atmosphere chamber communicating with said atmosphere chamber through an air passage formed in said housing;

a pressure outlet formed on said block and opening into said sub-atmosphere chamber;

said pressure outlet being disposed for connection to a vacuum advancer of a distributor of an engine;

a pressure inlet formed on said block and communicating with said pressure outlet;

said pressure inlet being disposed for connection to an intake manifold of the engine;

at least one air outlet formed on said housing and opening into said sub-atmosphere chamber;

said air outlet being disposed for connection to an air bleed of a carburetor of the engine;

first valve means disposed in said sub-atmosphere chamber for normally closing said air outlet;

a bellows disposed in said atmosphere chamber for forming therein a chamber to be confined with the air or gas at a predetermined pressure;

said bellows being of the type that expands as the atmospheric pressure decreases; and second valve means connected to said bellows for normally opening said pressure outlet;

said second valve being disposed to open said pressure outlet and push said first valve means so as to open said air outlet by the expansion of said bellows.

3. An altitude compensating apparatus for use with an internal combustion engine comprising;

chamber defining means for forming an atmosphere chamber and a sub-atmosphere chamber therein;

both of said chambers being supplied with the atmosphere;

at least one air outlet formed on said chamber defining means and opening into said sub-atmosphere chamber;

said air outlet being disposed for connection to a carburetor of an engine;

at least one bellows disposed in said atmosphere chamber for forming therein a chamber to be confined with the air or gas at a predetermined pressure;

said bellows being of the type that expands as the atmospheric pressure decreases; and valve means disposed in said sub-atmosphere chamber and operatively connected to said bellows for normally closing said air outlet;

said valve means being disposed to open said air outlet by the expansion of said bellows.

4. An altitude compensating apparatus as claimed in claim 3 further comprising;

a shaft fixed to said bellows at one end thereof and facing on said valve means at the other end thereof;

said shaft being shifted with the expansion of said bellows to contact with said valve means, thereby moving said valve to open said air outlet.

5. An altitude compensating apparatus as claimed in claim 3 further comprising;

a diaphragm disposed within said chamber defining means for forming a pressure chamber and said sub-atmosphere chamber;

said pressure chamber being supplied with the negative pressure from the carburetor and the atmospheric pressure from said atmosphere chamber;

said valve means being formed on said diaphragm; and a second valve means connected to said bellows for normally permitting the atmospheric pressure to be supplied in said pressure chamber;

said second valve means stopping the supply of the atmospheric pressure into said pressure chamber when said bellows expands.

* * * * *